US009175536B2

(12) United States Patent
Walls

(10) Patent No.: US 9,175,536 B2
(45) Date of Patent: Nov. 3, 2015

(54) PIPE END PLUG APPARATUS AND METHOD

(76) Inventor: Francis Walls, North Little Rock, AR (US)

( * ) Notice: Subject to any disclaimer, the term of this patent is extended or adjusted under 35 U.S.C. 154(b) by 605 days.

(21) Appl. No.: 13/216,701

(22) Filed: Aug. 24, 2011

(65) Prior Publication Data

US 2013/0048312 A1 Feb. 28, 2013

(51) Int. Cl.

| | |
|---|---|
| ***E21B 43/02*** | (2006.01) |
| ***E21B 33/02*** | (2006.01) |
| ***E21B 43/01*** | (2006.01) |

(52) U.S. Cl.

CPC ..... *E21B 33/02* (2013.01); *E21B 43/0122* (2013.01)

(58) Field of Classification Search

CPC ..... E21B 33/02; E21B 43/0122
USPC ..... 166/85.3, 85.4, 92.1, 94.1, 386, 387; 138/96 R; 285/901
See application file for complete search history.

(56) References Cited

U.S. PATENT DOCUMENTS

| | | | | | |
|---|---|---|---|---|---|
| 1,442,638 | A | * | 1/1923 | Baxley | 29/252 |
| 1,607,463 | A | * | 11/1926 | Kent | 166/92.1 |
| 1,664,643 | A | * | 4/1928 | Rasmussen | 166/92.1 |
| 1,822,141 | A | * | 9/1931 | Gallaher | 166/92.1 |
| 1,828,124 | A | * | 10/1931 | Bower | 166/92.1 |
| 2,256,775 | A | | 9/1941 | Hubbell | |
| 4,178,967 | A | | 12/1979 | Streich | |
| 4,291,762 | A | * | 9/1981 | Gudgel | 166/85.4 |
| 4,421,139 | A | | 12/1983 | Nickles | |
| 4,461,354 | A | * | 7/1984 | Buras et al. | 166/343 |
| 4,584,162 | A | | 4/1986 | Yoli | |
| 5,121,797 | A | * | 6/1992 | DeCuir, Sr. | 166/386 |
| 5,213,157 | A | * | 5/1993 | Wills | 166/79.1 |
| 5,904,377 | A | | 5/1999 | Throup | |
| 2011/0126933 | A1 | | 6/2011 | Bowie | |

* cited by examiner

*Primary Examiner* — William P Neuder
*Assistant Examiner* — Kristyn Hall
(74) *Attorney, Agent, or Firm* — Daniel Boudwin; Global Intellectual Property Agency LLC

(57) ABSTRACT

An open-ended pipe engagement device with a saddle portion that attaches around an open pipe, a structural platform comprising a tapering plug, support bars to prevent dislodgement of the device and threaded rods to winch the platform and plug onto the pipe end to be sealed. The device provides a means to safely cap and plug a leaking pipe end and allow the pipe to resume normal activity thereafter. The saddle portion provides a structural a base from which the plug and associated platform are positioned and winched into place, counteracting any fluid pressure exiting the leaking pipe. The plug comprises a tapering and conforming structure with a centrally located through hole for which to direct fluid as the platform is lowered and once the plug is engaged. Above the plug and through the platform is a section of pipe for which to direct the leaking fluid after the apparatus has been secured to the end of the pipe, effectively controlling the leak and allowing normal operation of the well to resume.

14 Claims, 3 Drawing Sheets

PIPE END PLUG APPARATUS AND METHOD

BACKGROUND OF THE INVENTION

1. Field of the Invention

The present invention relates to pipe plugs and devices utilizing a drive means to insert a plug into an open-ended pipe. More specifically, the present invention relates to an apparatus and method that forcibly inserts a tapered plug into a pipe end to eliminate leaking fluid therefrom, comprising a pipe saddle surrounding the pipe and a means for drawing the plug into the open pipe using a safe and reliable method that allows normal operation to be resumed shortly after its application.

2. Description of the Prior Art

Hydrocarbon drilling and production operations involve drilling deep within the ground to reach natural reserves for extraction. These drilling operations involve immense downhole well pressure, as the deposits are under considerable pressure in their natural state prior to being extracted. This creates potential safety hazards for the operators involved in the drilling process, a potential hazard for the environment and risk for equipment utilized in the process if safety measures are bypassed or overcome. If a drilling operation is not carefully managed and operated, an event known as a well blowout can occur. A well blowout involves an uncontrolled release of crude or natural gas from a well after pressure control and other safety systems have failed to properly activate. These situations lead to dispersement of petroleum products and other downhole matter into the local environment, which creates contamination issues that can kill local wildlife and create a flammability risk for nearby well workers. Uncontrolled or lengthy well blowouts can be catastrophic for a region and devastating to the local ecosystem. These events are also extremely costly, from the perspective of the well owner and the local populous that has to live in proximity to such wells.

Adequate safety measures are therefore in place to prevent such occurrences; however blow outs are still a concern for the drilling and petroleum industry, as their results can have disastrous consequences for those directly involved, as well as for those downstream from the event that rely on a given habitat for food and jobs. Of particular concern with regard to the present invention are deep water drilling activities, wherein wells are accessed several thousand feet below the ocean surface. This type of drilling has increased in recent years, and has included some notable blowout events that have crippled entire regions and caused considerable damage to the local environment.

Safety measures to combat these risks include blowout preventer devices, which are most commonly categorized into the ram or annular blowout preventers. These devices have been developed to prevent blowout events and to deal with the varying pressures and uncontrolled flow of fluid from a downhole well during drilling. They comprise large, specialized valves used to seal oil and gas wells. While fulfilling a given requirement when in operation, these devices are not completely foolproof, and have been known to fail.

The present invention comprises a device designed to seal a leaking well or pipe after a blowout or leak has occurred. The devices currently available in the prior art lack the ability to securely and safely plug a gushing pipe under high pressure, and to allow the continued operation of the pipe thereafter. The present invention is adapted to couple with an open pipe end using a saddle device, which surrounds the circumference of a pipe and provides a base for which to winch down a sealing structure that further comprises a platform having a blowout plate, a pipe plug, placement for working vehicles or tools and an orifice to direct the leaking fluid into an attached pipe. The platform is a large, three sided structure that supports the plug and directs the high pressure fluid through its central orifice during operation. Between the platform and the saddle are vertical support arms that are utilized to provide stability and prevent separation between the pipe end and the platform as the two are engaged. A set of threaded rods are utilized to draw the platform towards the open pipe, slowly closing the gap between the plug and the open pipe until the plug engageably seats therein, sealing the leak and routing the pipe fluid into an attached pipe above the platform. The rods are controlled by a powered drive means, such as a rotary drilling tool that allows the rods to rotate and advance the platform closer to the pipe.

The primary goal of the present invention is to engage a leaking pipe in a controlled and safety-conscious manner, utilizing a device that can be carefully controlled and lowered onto a leaking pipe end for closure thereof. The device employs redundant means to prevent dislocation during operation, which could lead to further problems. It also allows for continued operation of the pipe after engagement of the device. In this way, the well experiences minimal downtime while reducing the amount of dispersed petroleum therefrom.

Devices in the art have been disclosed for pipe plugs with varying structural features and designs. While these devices may satisfactorily fulfill a given requirement, they fail to describe the structural elements of the present invention, its spirit or its method for capping to and plugging a leaking pipe end.

U.S. Pat. No. 5,904,377 to Throup describes a pipe fitting adapted to install within an aperture of a fluid container. The device comprises an inner and outer co-axial sleeve member, along with a split, helically wound washer. The device is adapted to envelope a pipe and provide a plug for an aperture along its outer surface. This device is useful for plugging holes in the surface of a pipe, but is not adapted to engage the end of a pipe and provide a plug to prevent fluid leakage therefrom.

U.S. Pat. No. 4,584,162 to Yoli describes a plug designed to close steam lines in a boiling-water reactor. The device comprises an elongated rubber member that is compressed by axial compression in order to form a seal that holds the plug in place within the pipe and prevents leaking steam therefrom. The mechanism for achieving the plug seal is similar to the present invention, wherein drive screws draw a platform having a plug into the end of a pipe. While similar in concept, its structure and its application range vastly differs from the present invention.

U.S. Published Patent Application No. 2011/0126933 to Bowie describes a pipe end-sealing tool that engages the outer wall of the pipe and provides a means to pressure test the integrity of the pipe. This device engages a pipe end with an external means, allowing a plug to be fitted therein. The intent and structure of the Bowie device, however, are substantially divergent from the present invention.

The present invention provides a novel means and method for engaging a pipe end with a plug and simultaneously providing an outgoing route for flowing fluid therethrough. A saddle is attached to the exterior of the pipe below the pipe end, and is used as a ground support to winch a platform into place over the leaking pipe end. A tapered, apertured plug seals the plug and provides an auxiliary pipe for which to divert exiting fluid. Support bars establish a safeguard for the winching means, preventing the platform from dislodging therefrom under pressure load from existing pipe end fluid. They further allow adjustment of the plug position to ensure the plug properly seats into the pipe end. Prior to engagement, the aperture in the plug provides a path for exiting fluid to reduce pressure on the platform as it is lowered into place. The devices in the prior art fail to address the needs satisfied by the present invention. Further, its structure substantially diverges in design elements from the prior art. Consequently it is clear that there is a need in the art for an improvement to existing pipe end plug devices. In this regard the instant invention substantially fulfills these needs.

SUMMARY OF THE INVENTION

In view of the foregoing disadvantages inherent in the known types of pipe end plug devices now present in the prior art, the present invention provides a new plug wherein the same can be utilized for providing convenience for the user when capping and diverting leaking fluid from a gushing pipe end, particularly suited for blowout wells or those wherein a pipe end is accessible and leaking fluid is exiting therefrom.

It is therefore an object of the present invention to provide a new and improved pipe end plug device that has all of the advantages of the prior art and none of the disadvantages.

Another object of the present invention is to provide a pipe end plug device with a saddle that is attachable around the pipe, along with a platform to be lowered onto the pipe end to fit a plug therein, effectively sealing the leaking pipe end.

Another object of the present invention is to provide a compression-fitting plug that is forcibly inserted into a leaking pipe end, and one that includes a means to divert the pipe contents therethrough during and after placement.

Another object of the present invention is to provide a safe and stable means and method for plugging a leaking pipe end, and one that incorporates redundancy into its design to maintain control in the event of an element failure.

Yet another object of the present invention is to provide a plug device that reduces downtime of the well, reduces the amount of time the leak is active, and provides a means to quickly regain operation of the well after placement of the plug.

A final object of the present invention is to provide a device that is capable of functioning with any leaking pipe end, from minor leaks above ground to high pressure blow-outs that are associated with deep water offshore drilling operations.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
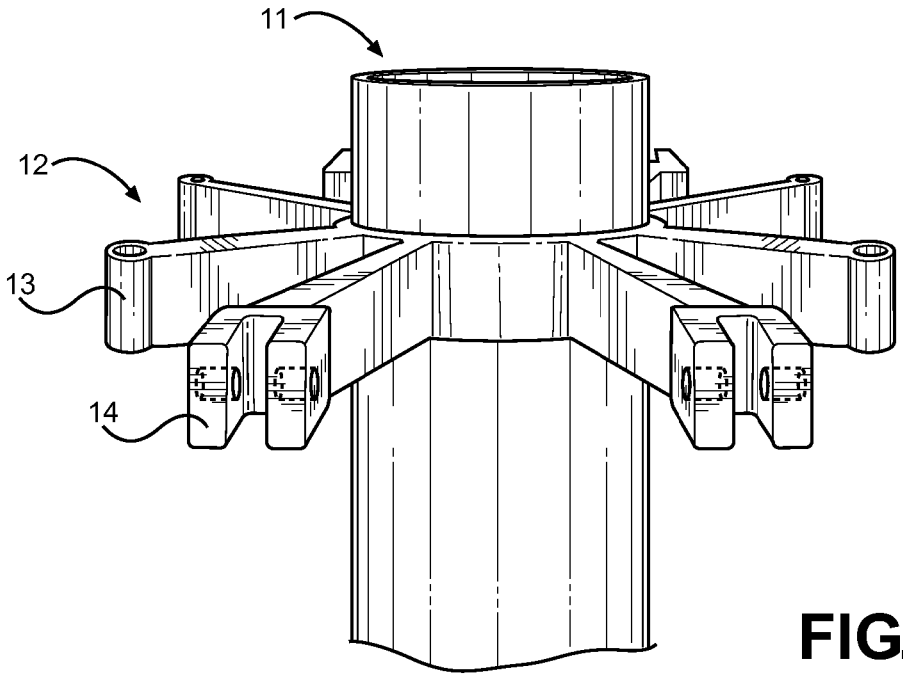
FIG. 1 shows a perspective view of the saddle engaged on a pipe end.

Reference is made herein to the attached drawings. Like reference numerals are used throughout the drawings to depict like or similar elements of the pipe end plug device. For the purposes of presenting a brief and clear description of the present invention, the preferred embodiment will be discussed as used for plugging a leaking pipe end. The figures are intended for representative purposes only and should not be considered to be limiting in any respect.

Referring now to FIG. 1, there is shown a saddle 12 and pipe end 11 as described in the present invention. The saddle 12 comprises a two-piece structure that is affixable around the outer circumference of a pipe. The two pieces clamp together to form a coherent structure around the pipe exterior, in close proximity to the pipe termination to provide a base structure or ground for which to support a plug and associated platform. The saddle comprises an annular member adapted to mate flushly with the exterior of the pipe, along with radial projections that form support bar attachment lugs 14 and threaded rod engagement arms 13. The support bar attachment lugs 14 provide a coupling point for a slotted support bar that extends from the saddle to the above-positioned plug platform in a vertical orientation. The threaded rod engagement arms 13 provide a threaded shank for which to support a threaded rod that also extends vertically into the above-positioned plug platform. These rods are utilized to draw the platform towards the pipe end 11 while in operation. The engagement arms 13 provide a means to support the rods and allow rotation therein, while a rotary drive means is affixed beneath the arms 13 to rotate the rods and draw the platform towards the pipe end 11. In the configuration as shown in FIG. 1, the saddle 12 is positioned near the pipe end 11. The pipe end 11 can be an existing pipe termination or a pipe that has ruptured and one that was subsequently machined or prepped to form a flat interface. The flat interface is not required, but facilitates engagement of the pipe plug and a proper seal to prevent further leaking.

Figure 2:
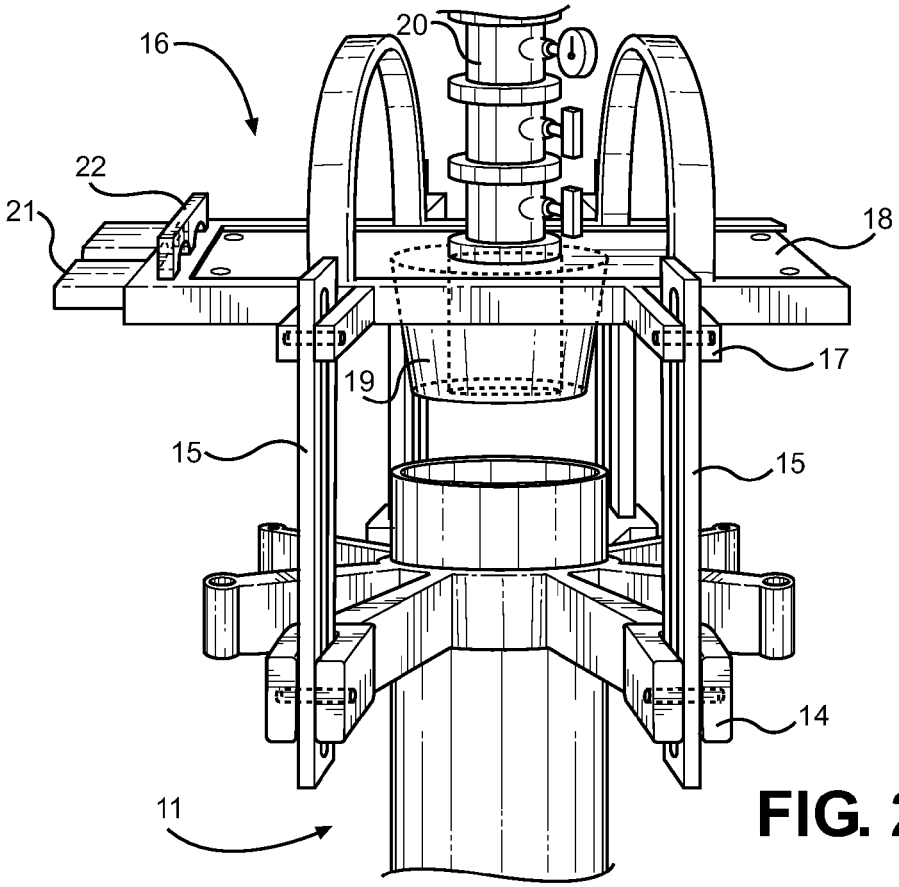
FIG. 2 shows a perspective view of the saddle in connection with a plug-supporting platform, utilizing support bars to maintain its static position.

Referring now to FIG. 2, there is shown a perspective view of the pipe end plug apparatus as described by the present invention, wherein a plug platform 16 has been positioned above a pipe end 11. A plurality of support bars 15 is clamped in a vertical position, spanning the distance between the pipe end and the platform 16 to support the platform 16 in a static position. The support bars 15 comprise elongated and slotted members that extend from the saddle support bar attachment lugs 14 to similar lugs 17 provided along the periphery of the platform 16. Fasteners are utilized along the slots of the support bars 15 to secure the platform position during operation, preventing dislodgement, dislocation or misalignment of the platform 16 while being drawn closer to the pipe in operation.

The platform 16 comprises a three-sided frame structure that supports a flat blowout plate 18 and several elements that facilitate operation of the apparatus. The frame may comprise out of plane support elements to prevent flexure or failure of the platform while subjected to pressure loading from pipe end fluid. The blowout plate 18 is fastened to the frame, and provides a centrally located aperture, under which is mounted a plug device 19 for engagement of the pipe end. The plug 19 comprises a tapering structure, in the form of a truncated cone or frustum, which is adapted to fit into the opening of the pipe end and create an air-tight seal therein. The plug 19 is comprised of a material that is designed to conform to the inner walls of the pipe end 11, allowing the apparatus to compress the plug 19 into the pipe end 11 and facilitate leak closure. Along the centerline of the plug 19 is a central through hole, wherein an auxiliary pipe 20 is provided. The auxiliary pipe 20 is fitted with two valves to control flow therethrough, along with a pressure gauge to monitor pipe pressure after fitting the plug 19 onto the pipe end. Two valves are provided to allow redundancy, in the event of one valve failure, a second valve may be utilized to control flow through the auxiliary pipe.

Along an end of the platform frame are two platforms extensions 21 to support winch tools or machines utilized to position the blowout plate 18 and platform 16 down onto the pipe end. Depending on the application, these machines may range from operable winches to undersea robots that operate tools to control the position of the platform 16 over the pipe. A protective wall 22 is provided in proximity to the platform extensions 21 and along the end of the frame to provide protection from flying debris, fluid and other articles while the operational tools are attached thereon and are in operation. This ensures any expensive auxiliary tools and machines are afforded a level of protection while in operation.

Positioning the platform 16 over the pipe end involves several steps that are necessary to carefully place the apparatus thereabove without introducing a risk of destroying the device or losing control of machinery. After the saddle is placed around the pipe, the three-sided channel is moved over the leaking pipe end and secured via the support bars 15, locking it in a static position. The leaking fluid is able to continue to flow unperturbed through the body of the three-sided channel. The blowout plate 18 is then positioned at the open end of the three-sided channel for placement therein. Lines are extended from winches placed on the oppositely positioned platforms 21 and fed through apertures in the protective wall 22. The lines are secured to the blowout plate 18 and utilized to pull the plate 18 through the channel and over the leaking pipe end. The aperture in the blowout plate is sized to be approximately the same size as the pipe diameter, or at a minimum 75% thereof. This allows fluid to flow through the plate uninterrupted and reduce the pressure on the plate 18 and support bars 15. A series of fasteners are placed through the frame and blowout plate 18 to secure the two in position.

Figure 3:
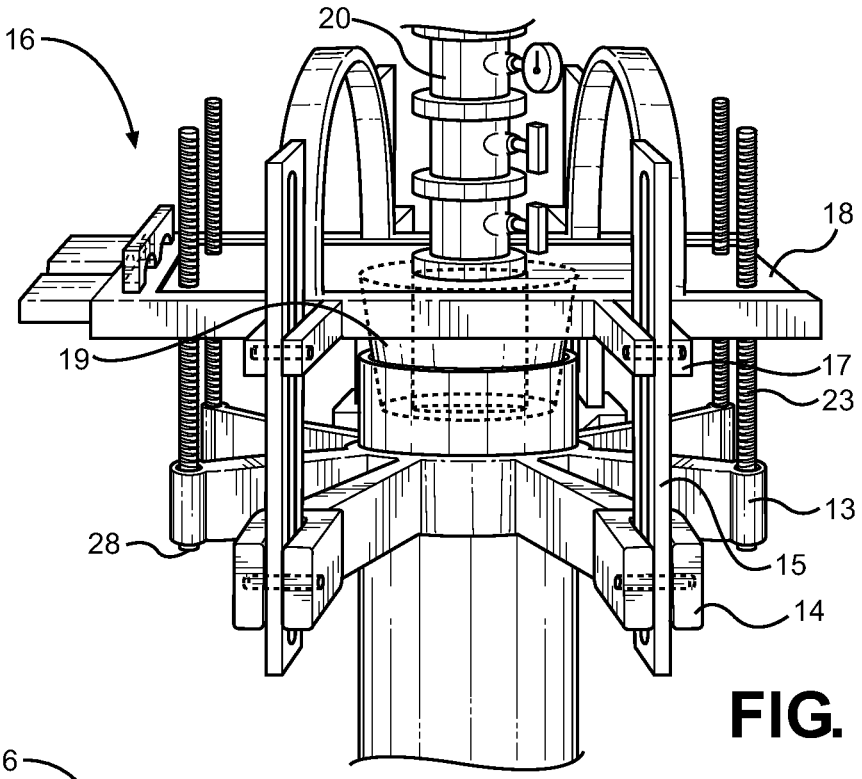
FIG. 3 shows a perspective view of the present invention in its working configuration, wherein threaded rods are advancing the platform towards the saddle, and the plug into the pipe end.

Referring now to FIG. 3, there is shown a perspective view of the present invention in a working position, wherein the platform 16 and plug 19 are being lowered into the pipe end for sealing a leaking fluid flowing therefrom. After the support bars 15 are secured and the platform 16 is in position over pipe end, threaded rods 23 are placed through the rod support arms 13 and threaded through corresponding tapped holes in the platform. Below the support arms 13 and attached to the end of each rod is coupling 28 that allows a winch, rotary or crank tool to rotate the threaded rods 23. As they are rotated, the corresponding threads in the platform 16 tapped holes are forced to advance along the rod lengths. The rods 23 are independently controlled, or optionally controlled in unison by a device that can accurately control the platform position to ensure a level structure as it is lowered. Fasteners along the support bar 15 slots are loosened during this operation to allow the lugs 17 to travel along the slot without impediment. They may be operably tightened and resecured at any moment to maintain integrity of the apparatus and the position of the platform. This ensures the operation is conducted in a controlled and methodical fashion, wherein positional control is maintained throughout the process. A plurality of threaded rods 23, support bars 15 and associated connections are provided to ensure redundancy and adequate structural support while undergoing pressure loaded from exiting fluid. The through hole in the plug 19 also provides a path to relieve pressure as it exits the pipe end, as it can traverse through the platform 16 and associated pressure loads are bypassed. Once the plug is completed seated, the leak can no longer exit the pipe end, except through the auxiliary pipe 20, which is then controlled by the valves thereon.

Figure 4:
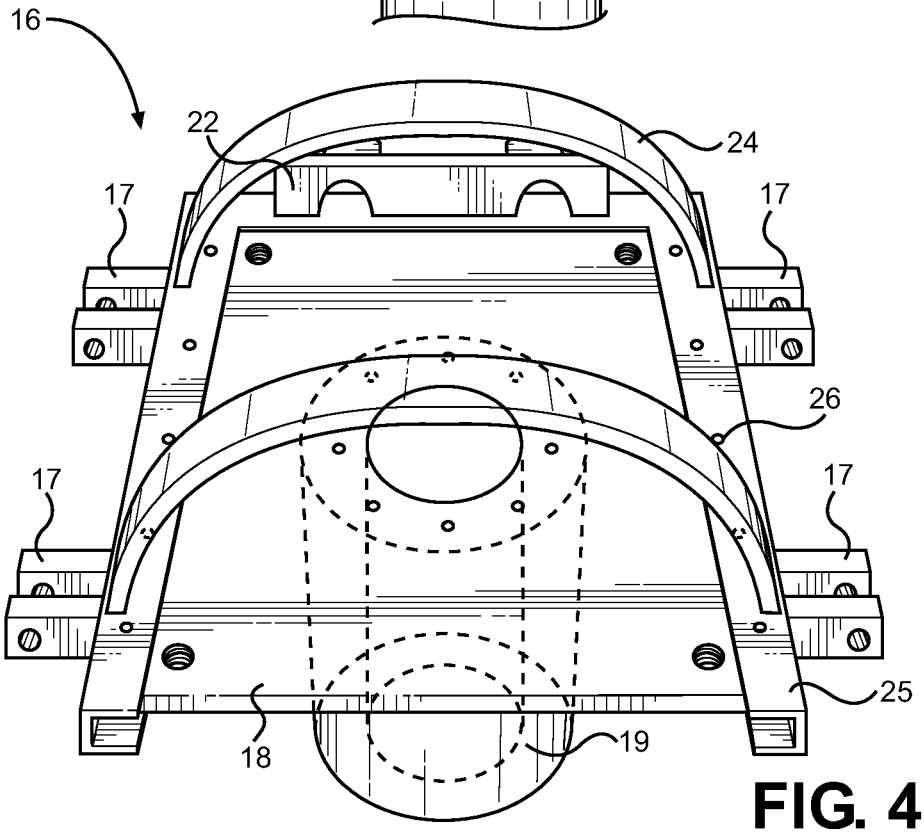
FIG. 4 shows an overhead perspective view of the platform, including its three-sided configuration and through hole for pressure relief during installation, and finally an auxiliary pipe fitting for accessing the pipe contents to continue operation of the pipe after plug installation.

Referring now to FIG. 4, there is shown an overhead perspective view of the present platform 16, wherein the platform 16 is highlighted. The platform 16 comprises a planar blowout plate fitted into a three-sided channel frame 25 with out-of-plane structural supports 24 to improve the frame's rigidity under pressure loading. The channels of the frame 25 allow the blowout plate 18 to slideably engage the frame from the open end thereof, while fasteners 26 through the channel 25 and plate 18 eliminate relative movement. A plurality of support bar lugs 17 are provided along an elongated edge of the device, and are utilized to couple with the slots of the support bars that extend towards the saddle. These lugs are vertically aligned with the associated lugs on the saddle, so as to provide a vertical path for the platform lugs to traverse along the support bar slots.

When the platform 16 is positioned above a leaking or gushing pipe end, the blowout plate 18 is removed from the frame 25. The frame 25 is lowered over the pipe end and secured using the support bars, which secure the platform in position over the pipe. The blowout plate 18 and attached plug are then slid into the open end of the frame 25 and fastened into place along the frame. Leaking fluid and debris is funneled through the central through hole in the blow out plate 18 and plug 19, while also diverting a portion of leaking fluid away from the platform 16 as it strikes the blowout plate 18. Once the plate 18 is in position, the threaded rods may be engaged to being drawing the device towards the open pipe end. The protective wall 22 along the frame 25, as shown in perspective in this figure, provides a boundary that prevents gushing fluid or debris from striking any attached tools or operating machinery.

Figure 5:
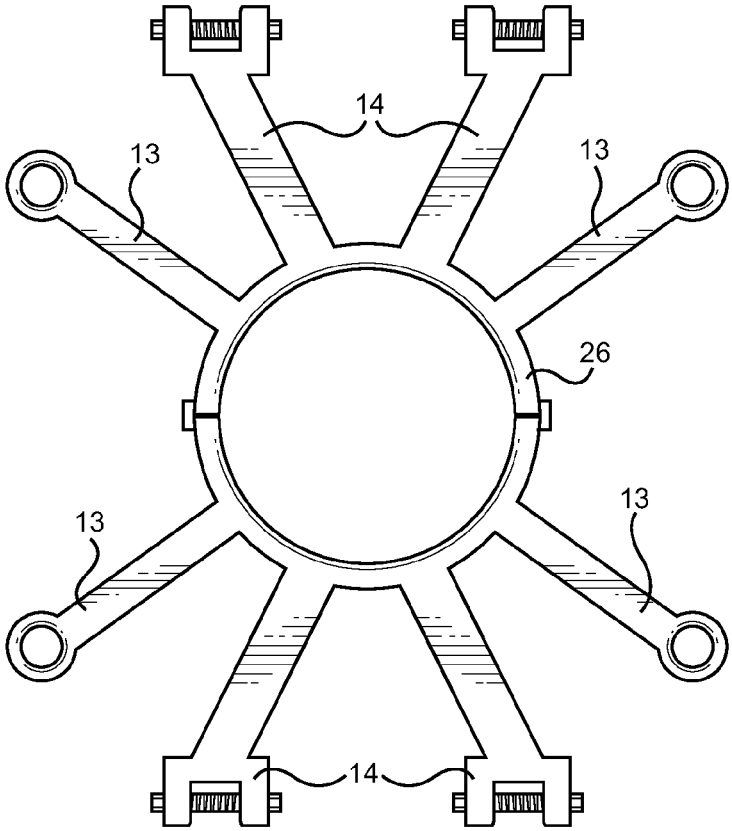
FIG. 5 shows an overhead view of the saddle, including its two-piece construction, rod engagement arms and support bar attachment lugs.

Referring now to FIG. 5, there is shown an overhead view of the saddle, including its two-piece construction and a plurality of protrusions extending therefrom. The base ring 26 of the saddle circumferentially engages a pipe and is secured thereabout to form a unitary structure. A plurality of support bar lugs 14 and threaded rod engagement arms 13 protrude from the base ring 26. The quantity thereof is dependent upon end user requirements and the specific size and scope of the pipe leak being plugged. More arms may be required for structural considerations, or fewer if utilized in a low pressure leak situation. Additionally, more than one saddle may be utilized around a single pipe, wherein each saddle stacked and connected for improved structural grounding and support.

Figure 6:
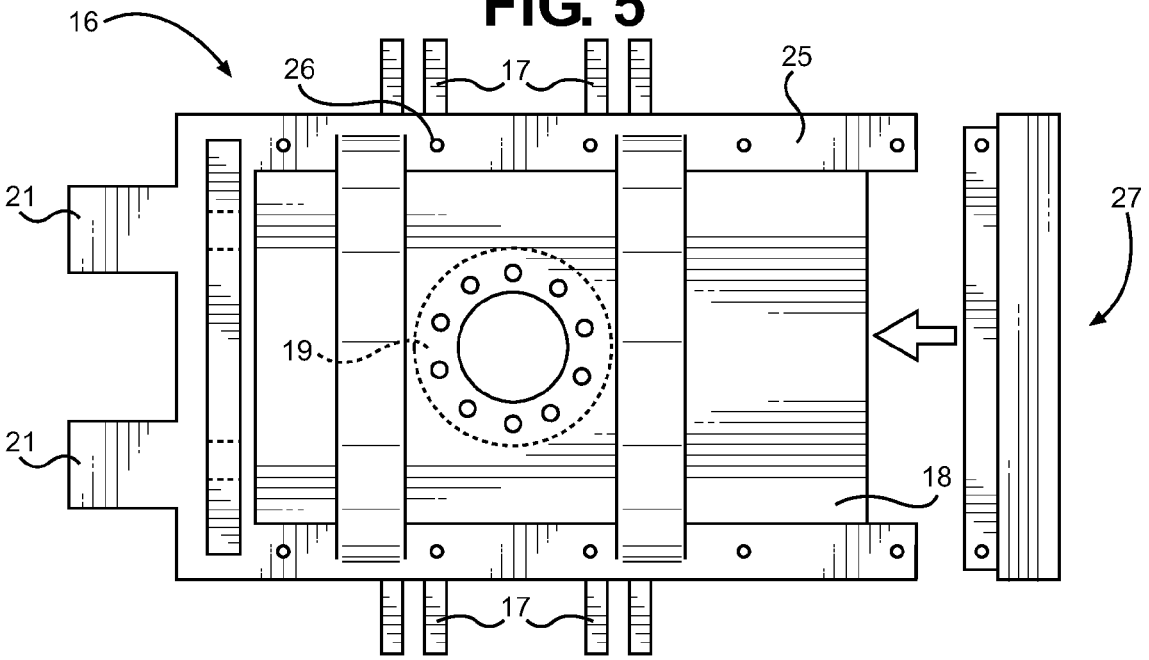
FIG. 6 shows an overhead view of the platform being secured after the pipe has been plugged, its three-sided structure is closed off by a fourth edge to prevent dislodgement of the blowout plate and plug.

Referring now to FIG. 6, there is shown an overhead view of the platform 16, wherein the three-sided frame 25 is shown. A frame close-out cap 27 is positioned along the open end of the frame 25. The cap 27 may be utilized after the platform has been lowered over the pipe and the plug has been inserted, or alternatively may be installed after the blowout plate 18 is placed into the frame 25 and fastened. The cap 27 provides a securing means to prevent the blowout plate 18 from displacing along the frame 25 length or overstressing the fasteners between the plate 18 and the frame 12. The device comprises a plate portion that abuts against the end of the blowout plate 18, along with a frame member that attaches to the ends of the three-sided frame 25 to provide a close-out thereof. This device also eliminates any flexure or torsion of the plate and frame under load, as the unsupported, open end of the frame is therefore capped and secured to create a more rigid frame and torque box.

Together, the elements and steps of the present invention provide a novel means to position a plug over a gushing pipe end, and to controllably and safely lower a plug over the pipe to seal any leaking fluid. Each step in the process, and each element of the device, is designed with safety in mind. Structural members are redundant and the plugging operation is conducted in a methodical process. After the plug and platform have been lowered, and the pipe end sealed, the pipe may resume normal operation. Flow from the pipe is routed through the auxiliary pipe, reducing overall downtime for the well and continued petroleum extraction operations. The plug apparatus may remain in position indefinitely, requiring minimal oversight or maintenance after placement.

Materials contemplated for the design of the rigid elements of the apparatus include stainless steel, which reduces the risk of flammability, as sparks from this material type are generally shorter and less dense. Likewise, this material has an increased elongation to failure over traditional steels, which improves the ability of the present invention to undergo significant pressure loading before fracture or ultimate failure.

In practice, the device may be utilized for a number of different scenarios. These include any magnitude of leak or environmental extreme. The elements of the device are suited for high pressure applications and environments, as well as low pressure or ambient conditions. Its structure can be scaled to fit any requirement, falling within the scope and spirit of the invention.

To this point, the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A plug apparatus for attaching to and sealing an open pipe end, comprising:

a pipe saddle adapted to attach around the exterior surface of a pipe, said saddle having a a plurality of pipe saddle support bar attachment lugs and threaded rod engagement arms;

a platform having a plug attached to a planar blowout plate, a frame adapted to accept and support said blowout plate, and further having a plurality of platform support bar attachment lugs, each of said a plurality of platform support bar attachment lugs of said platform vertically aligned with each of said a plurality of pipe saddle support bar attachment lugs disposed on said pipe saddle;

elongated support bars each having a slot running along its length, both of said plurality of pipe saddle and platform support bar attachment lugs engaging said support bar slots;

threaded rods that extend from said pipe saddle engagement arms to tapped holes in said blowout plate, said rods adapted to freely rotate within said arms, said tapped holes adapted to traverse said rods during said rotation;

said plug and said blowout plate further comprises a central and aligned through hole through which an auxiliary pipe is fitted.

2. The apparatus of claim 1, wherein said pipe saddle further comprises a two-piece construction, wherein said saddle pieces are joined around an exterior surface of said pipe.

3. The apparatus of claim 1, further comprising at least one addition pipe saddle stacked with said pipe saddle for improved structural grounding and support of said platform.

4. The apparatus of claim 1, wherein said platform frame further comprises a three-sided frame with a channel wherein said blowout plate is adapted to slideably engage said channel.

5. The apparatus of claim 1, wherein said platform further comprises a plurality of platform extensions for winches adapted to pull said blowout plate into said three-sided channel.

6. The apparatus of claim 1, wherein said plug further comprises a truncated cone with tapering sidewalls.

7. The apparatus of claim 1, wherein said platform frame, blowout plate, support bars, threaded rods and saddle comprise a stainless steel material.

8. The apparatus of claim 1, wherein said auxiliary pipe further comprises a pressure gauge to monitor incoming fluid pressure and a plurality of valves to control fluid flow therethrough.

9. The apparatus of claim 1, wherein said support bar lugs further comprise fasteners to engage each support bar slot, said fasteners adapted to loosen or secure said lug at a position along said slot.

10. The apparatus of claim 1, further comprising a frame close-out cap adapted to engage said three-sided frame and enclose said blowout plate in a static position.

11. A method of plugging a leaking pipe end, comprising the steps of:

attaching a saddle about said pipe outer surface, positioning a three-sided channel above said pipe end;

securing said channel to said saddle using a plurality of slotted securing bars;

slideably engaging into said three-sided channel a blowout plate with an attached pipe plug and through hole to an auxiliary pipe above into said platform using a winch means;

securing threaded rods between said blowout plate and said saddle;

drawing said platform towards said pipe end by rotating said threaded rods;

engaging said pipe end with said plug and said auxiliary pipe.

12. A method of claim 11, further comprising the steps of:

utilizing a valve on said auxiliary pipe to control flow from said pipe end and resume operation of said pipe end.

13. A method of claim 11, further comprising the steps of:

fastening said blowout plate to said platform after said slideably engaging.

14. A method of claim 11, further comprising the steps of: securing said blowout plate in position within said platform with a close-out cap.

* * * * *